US006155470A

United States Patent [19]

Robison

[11] Patent Number: 6,155,470

[45] Date of Patent: Dec. 5, 2000

[54] ATV/BACKPACK-MOUNTED BOW CARRIER

[76] Inventor: Frankie Joe Robison, Rt. 2 - North Point Apts. #42, Poteau, Okla. 74953

[21] Appl. No.: 09/225,362

[22] Filed: Jan. 5, 1999

Related U.S. Application Data

[60] Provisional application No. 60/070,482, Jan. 5, 1998.

[51] Int. Cl.[7] ..... A45F 4/00

[52] U.S. Cl. ..... 224/585; 224/259; 224/261; 224/262; 224/417; 224/447; 224/484; 224/584; 224/916

[58] Field of Search ..... 224/916, 907, 224/259, 250, 401, 547, 584, 585, 271, 272, 261, 262, 153, 417, 447, 454, 484, 155

[56] References Cited

U.S. PATENT DOCUMENTS

| | | | |
|---|---|---|---|
| 1,099,518 | 6/1914 | Smith | 224/268 |
| 1,466,715 | 9/1923 | Hart | 224/907 |
| 3,749,294 | 7/1973 | Johnston | 224/922 |
| 4,754,904 | 7/1988 | Fischer et al. | 224/259 |
| 5,337,907 | 8/1994 | McKenzie et al. | 224/268 |
| 5,664,721 | 9/1997 | Homeyer | 224/916 |
| 5,878,929 | 3/1999 | Leonard | 224/401 |

*Primary Examiner*—Gregory M. Vidovich
*Assistant Examiner*—Maerena W. Brevard
*Attorney, Agent, or Firm*—Hoffman, Wasson & Gitler

[57] ABSTRACT

A carrier for a bow can be carried by a user as a backpack or attached to an all-terrain vehicle (ATV). The carrier facilitates the transportation of the bow to any desired location. The bow is easily attached and detached from the carrier for its ease in use.

10 Claims, 6 Drawing Sheets

ATV/BACKPACK-MOUNTED BOW CARRIER

This application claims the benefit of the U.S. provisional application No. 60/070,482, filed Jan. 5, 1998.

BACKGROUND OF THE INVENTION

Hunting is a popular activity and is one that is as old as this country itself. Hunting is regulated by the various states and separated into seasons. Every state has a hunting season which is limited to bow hunting only. Hunters which engage in this type of hunting go into the woods with their equipment. They either carry their equipment or put it on to an all-terrain vehicle (ATV). It is common for a hunter to pick a spot in the woods and wait for game. Often, the hunter chooses to climb into a tree and wait in a tree stand. There is a need for a convenient way for the hunter to carry equipment into the woods to the spot that he chooses.

Various devices are available which hunters can use in the woods to carry a bow. U.S. Pat. No. 5,482,241 to Oglesby discloses a U-shaped bow support for attaching a bow to a tree. The bow support cannot be carried on the hunter's back or attached to an ATV. Osterholm, U.S. Pat. No. 3,465,928, discloses a quiver that can have a bow attached to it. The quiver does not have the capability to be attached to an ATV. U.S. Pat. No. 5,106,044 (Regard, III et al.), and U.S. Pat. No. 4,474,296 (Hartman) disclose stands for bows that are attached to the bow by screws. These stands are not used to carry the bow on a hunter's back or an ATV.

It is an object of this invention to provide a light-weight comfortable bow carrier that a hunter can carry.

It is also an object of the invention to have a bow carrier that is easily attached and detached from the bow.

It is a further object of the invention to have a bow carrier that is easy to manufacture and use.

SUMMARY OF THE INVENTION

The invention relates to a device that will hold a bow and can be carried on the hunter's back or can be mounted to the rack of an ATV. The device is easily attached to the rack of an ATV or carried by the hunter. It allows the hunter to have his hands free in order to engage in other activities.

The invention uses a support plate that has shoulder and waist straps attached to its front. These straps allow the user to carry the bow holder. The support plate may also have brackets connected to it which allow the bow holder to be secured to the rack of an ATV.

A bow carrier plate is attached to the back of the support plate. The bow carrier plate releasably retains a bow holder which is attached to the bow. The bow holder is a U-shaped member which has one leg screwed to the bow and the other leg retained by the bow carrier plate. The bow holder is quickly and easily separated from the bow carrier plate.

DETAILED DESCRIPTION OF THE INVENTION

Figure 1:
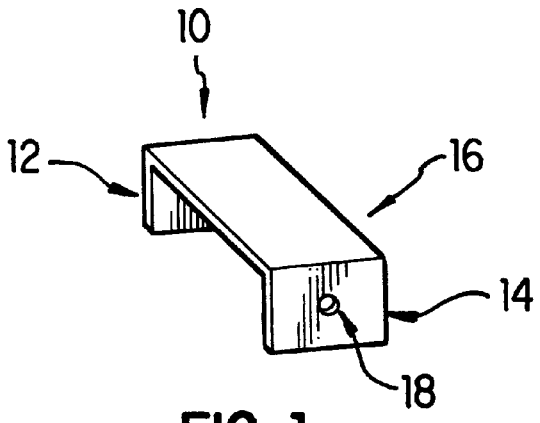
FIG. 1 depicts the bow holder.

FIG. 1 shows the bow holder 10. The bow holder 10 is a generally "U" shaped piece having a first leg 12, a second leg 14, connected by a central portion 16. The legs are 2 inches high and the central portion is 4¼ inches long. The holder is 1½ inches wide. The bow holder is preferably made of aluminum.

Figure 2:
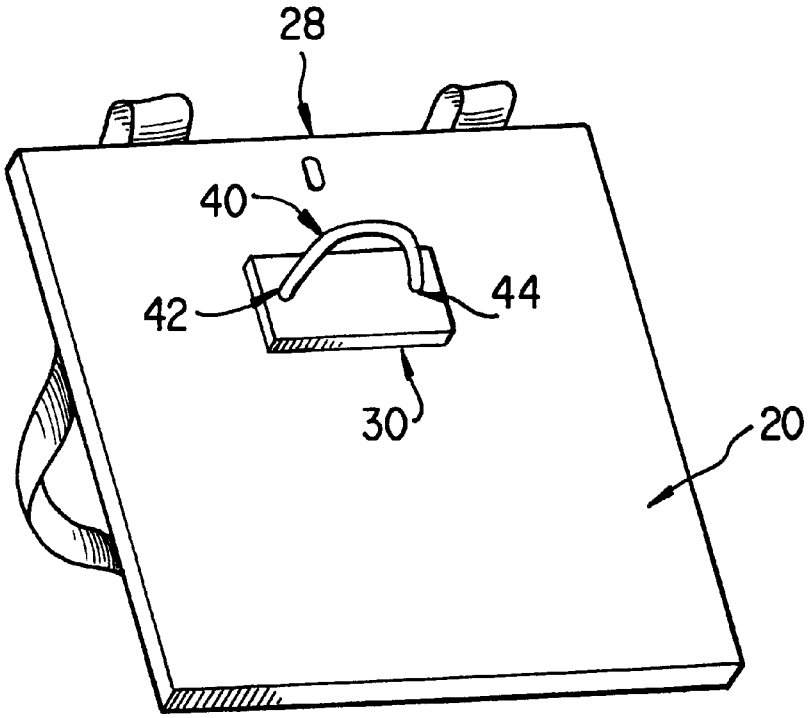
FIG. 2 shows the support plate with the bow carrier plate attached.
Figure 3:
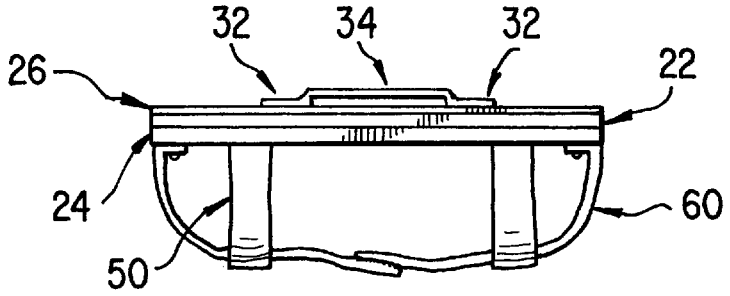
FIG. 3 is a top view of the support plate and bow carrier plate where the shoulder and waist straps are visible.

Turning to FIG. 2, a support plate 20 is shown with a bow carrier plate 30 attached thereto. The support plate is 12 inches long, 6½ inches wide and 1/16 inch thick. The bow carrier plate is 2¼ inches long, and 2¼ inches wide and 1/16 inch thick. The bow carrier plate has a safety strap 40. The safety strap 40 is connected on one end by a screw 42 and on the other by a snap 44. The strap can also be attached to opposite sides of the support plate. A top of the support plate 20 has an aperture 28. A top view of the support plate and bow carrier plate can be seen in FIG. 3. From this view you can see that the support plate 20 is made of a layer of aluminum 22. The front of the support plate has a foam layer 24 which is ¼ inch thick. The back of the support plate may be covered with a layer of camouflage fabric 26. Also seen in this view are the pair of shoulder straps 50 which connect to the waist strap 60. Clearly seen in this view is that the bow carrier plate 30 consists of two ends 32 connected to the support plate 20 with a center piece 34 which is spaced from the support plate 20. To connect the bow holder 10 to the support plate 20, the first leg 12 of the bow holder 10 fits between the space created between the center portion of the bow carrier plate 34 and the support plate 20. The first leg 12 is inserted downward into the space. The safety strap 40 extends over the top of the central portion and prevents the bow holder from inadvertently coming out by preventing its upward movement.

Figure 4:
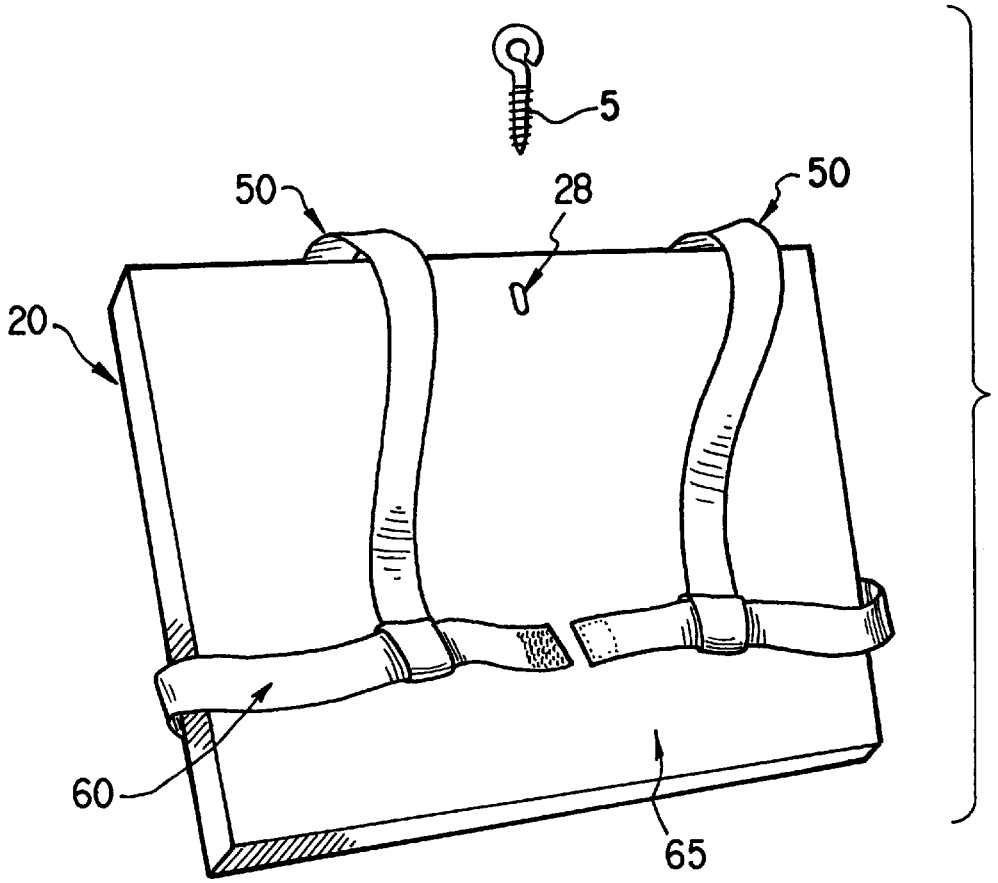
FIG. 4 is a front view of the support plate with the shoulder and waist straps clearly visible.

FIG. 4 shows the front view of support plate 20. As can be seen, the shoulder straps 50 have top ends which connect to the top edge of the support plate 20 and bottom ends which connect to the waist strap 60. The shoulder straps are made out of 1 inch nylon, and are adjustable. The waist strap 60 connects to itself in the middle by hook and loop fasteners 65. The support plate can be connected to a tree by fastening an eye-bolt 5 through the aperture 28 located at the top of the support plate 20.

Figure 5:
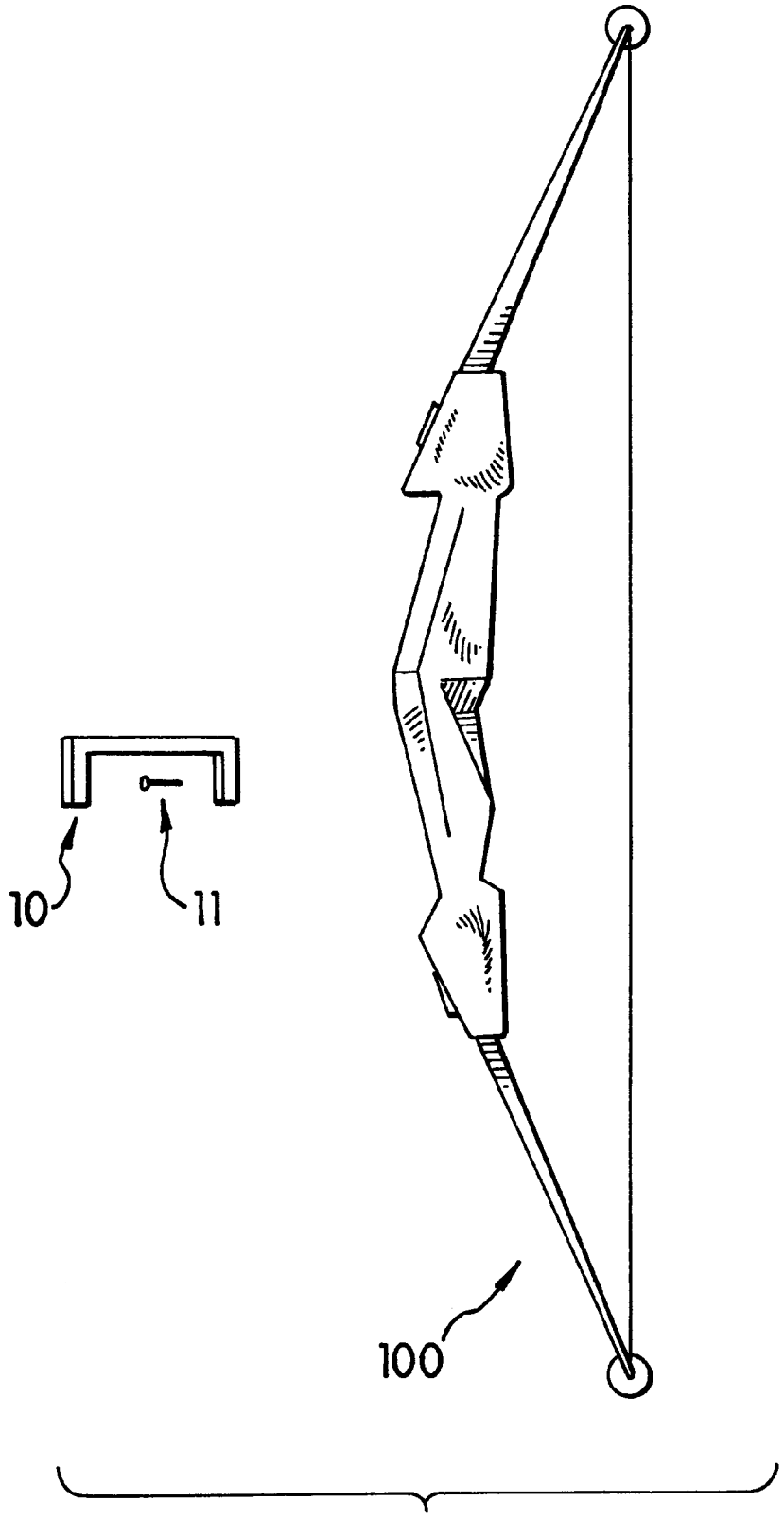
FIG. 5 depicts how the bow holder is attached to a bow.

FIG. 5 depicts how the bow holder 10 is connected to a bow 100. A conventional screw 11, can be used to pass through the aperture 18 in the second leg 14 of the bow holder. The screw passes through the aperture 18 and into the bow 100. The bow can be used with the bow holder still attached since it does not interfere with the operation of the bow when screwed to it.

Figure 6:
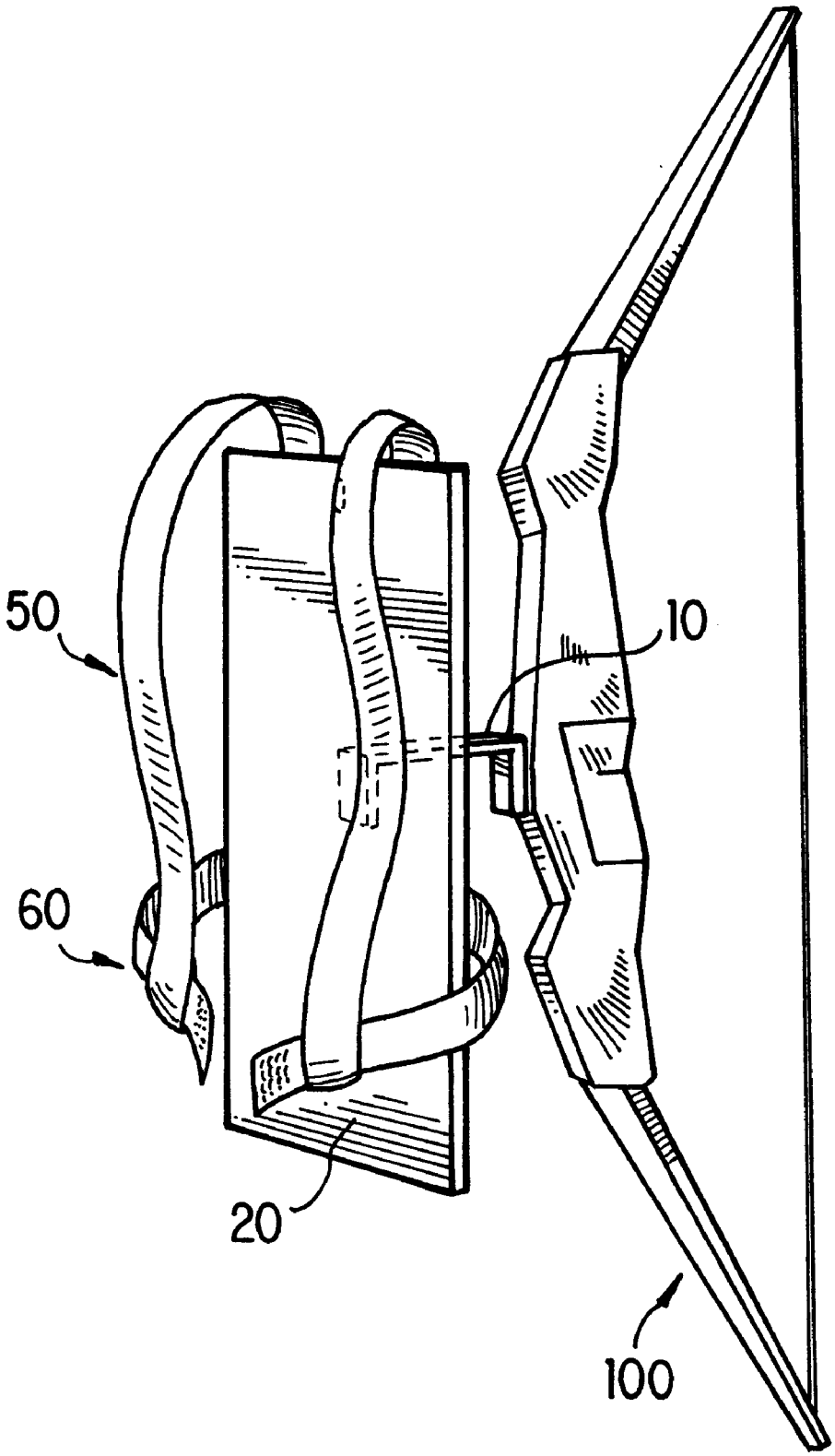
FIG. 6 shows the complete assembly of the support plate bow holder and bow.

Turning now to FIG. 6, the complete assembly of the support plate 20, the bow carrier plate 30, the bow holder 10, and the bow 100 can be seen. As will be noticed, the legs of the bow holder extend downward from the central portion 16 of the bow holder.

Figure 7:
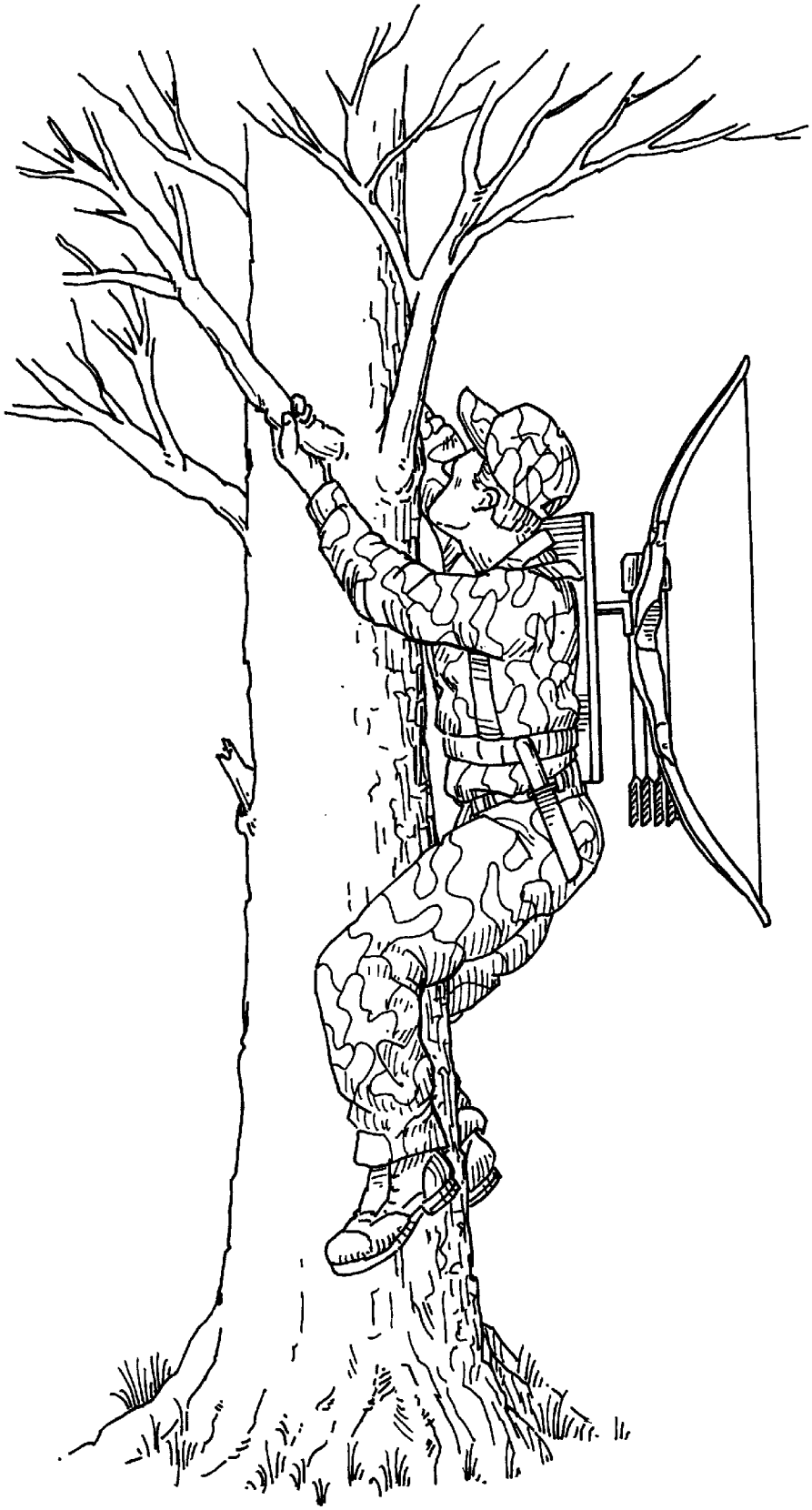
FIG. 7 shows the bow holder and support plate on a user.

FIG. 7 shows a user wearing the bow holder. As can be seen, the shoulder straps allow the user's hands to be free and enable him to climb a tree in order to reach a tree stand, for instance.

Figure 8:
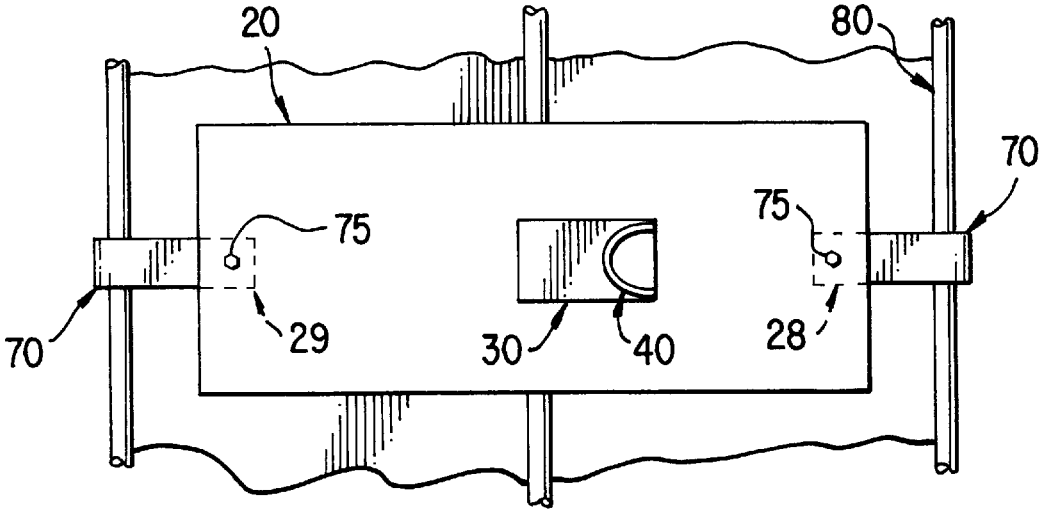
FIG. 8 is a top view of the support plate mounted to the rack of an ATV.

FIG. 8 shows a top view of the bow carrier attached to the rack 80 of the ATV. This is achieved by using J members 70 that are attached to the support plate by means of bolts 75. One of the J members is attached through a bolt which passes through the first aperture 28. The other J member attaches through a bolt which passes through a second aperture 29, located at the bottom of the support plate 20.

Figure 9:
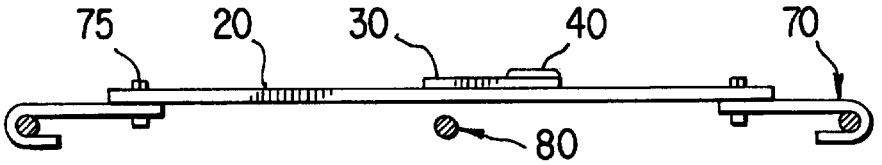
FIG. 9 is a side view of the support plate attached to the rack of an ATV.

FIG. 9 shows a side view of the bow carrier as it is attached to the rack 80 of the ATV. As can be seen, J members extend around the bars of the rack in order to securely maintain the bow carrier in its position.

Although an exemplary embodiment of the invention has been shown and described, it is appreciated that a number of changes, modifications or alterations may be made to the invention without departing from the spirit or scope of the invention.

What is claimed is:

1. A bow carrier, comprising:

a support plate having a first and second side;

a bow carrier plate attached to the support plate first side;

a U-shaped bow holder releasably attached to the bow carrier plate, the legs of the U-shaped bow holder being substantially equal, in length; and shoulder straps for attaching the bow carrier to a user attached to the support plate second side.

2. The bow carrier of claim 1, wherein the bow carrier plate comprises a center portion and two end portions, the center portion spaced from the support plate by the ends.

3. The bow carrier of claim 1, wherein the support plate comprises a metal layer and a foam covering.

4. The bow carrier of claim 1, further comprising a safety strap attached to the bow carrier plate.

5. The bow carrier of claim 1, further comprising a pair of J-shaped members attached to the support plate for attaching the bow carrier to an all terrain vehicle.

6. A bow carrier, comprising:

a support plate having a first and second side;

a bow carrier plate attached to the support plate first side;

a U-shaped bow holder releasably attached to the bow carrier plate, the legs of the U-shaped bow holder being substantially equal, in length; and a pair of J-members attached to the support plate for attaching the bow carrier to an all terrain vehicle.

7. The bow carrier of claim 6, further comprising shoulder straps attached to the support plate second side.

8. The bow carrier of claim 6, wherein the bow carrier plate comprises a center portion and two end portions, the center portion spaced from the support plate by the ends.

9. The bow carrier of claim 7, further comprising a waist strap attached to the support plate second side.

10. The bow carrier of claim 8, wherein the bow holder comprises a first leg, a central portion connected to the first leg and a second leg connected to the central portion wherein the bow holder first leg is placed between the support plate and the bow carrier plate center portion.

* * * * *